United States Patent [19]

Yamaguchi et al.

[11] 3,940,248

[45] Feb. 24, 1976

[54] METHOD FOR INHIBITING CORROSION OF METAL

[75] Inventors: Hideo Yamaguchi, Naruto; Takashi Kawasaki, Tokushima; Shigeo Takahashi, Tokushima; Akiyoshi Inubuse, Tokushima, all of Japan

[73] Assignee: Otsuka Kagaku Yakuhin Kabushiki Kaisha, Osaka, Japan

[22] Filed: June 13, 1973

[21] Appl. No.: 369,518

[30] Foreign Application Priority Data

June 15, 1972 Japan ..... 47-60172

[52] U.S. Cl. ..... 21/2.7 R; 21/2.5 R; 252/391; 252/392; 252/394; 260/250 AC

[51] Int. Cl.[2] ..... C23F 11/14

[58] Field of Search ..... 252/392, 394, 148, 8.55 E; 260/250 AC; 21/2.5 R, 2.7 R

[56] References Cited

UNITED STATES PATENTS

| | | | |
|---|---|---|---|
| 2,618,608 | 11/1952 | Schaeffer | 252/392 X |
| 3,413,227 | 11/1968 | Howard et al. | 252/392 X |
| 3,425,954 | 2/1969 | Ruzevick et al. | 252/392 |

OTHER PUBLICATIONS

Steck et al., Article in Journal of American Chemical Society, Vol. 81, 12–1959, pp. 6289–6291.

*Primary Examiner*—Herbert B. Guynn

*Attorney, Agent, or Firm*—Armstrong, Nikaido & Wegner

[57] ABSTRACT

A corrosion inhibiting composition which comprises an aqueus medium having dissolved therein an effective amount of at least one of water-soluble 8-hydroxy-s-triazolo[b]pyridazine compounds and watersoluble salts thereof, said water-soluble 8-hydroxy-s-triazolo[b]pyridazine compound having the formula of

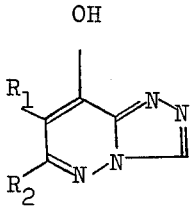

wherein $R_1$ is hydrogen atom or an alkyl group having 1 to 4 carbon atoms: $R_2$ is hydrogen atom, an alkyl group having 1 to 10 carbon atoms, phenyl, hydroxyphenyl, nitrophenyl, benzyl, hydroxybenzyl or nitrobenzyl group; and a method for inhibiting corrosion of a metal which comprises contacting a metal with said composition.

2 Claims, No Drawings

METHOD FOR INHIBITING CORROSION OF METAL

This invention relates to an aqueous corrosion inhibiting composition and a method for inhibiting corrosion of metals such as iron, copper, zinc, alloys thereof, etc.

In the prior art various water-soluble corrosion inhibitors for metals are known. For example, sodium nitrite, chromium trioxide and amine-based surfactants are known as water-soluble corrosion inhibitors for metals and have been extensively used for protecting the same from corrosion. However, such known inhibitors are not sufficient in practical uses. Although sodium nitrite displays an excellent corrosion inhibiting effect on ferrous metals which are brought into contact with water having dissolved therein said inhibitor, for example, the effect reduces markedly when ferrous metals coated with the inhibitor is placed in the air. Further, the nitrite has a considerable toxicity, causing water pollution when exhausted to water system without post-treatment. Chromium trioxide displays corrosion inhibiting effect not only on ferrous metals but also on other metals such as copper, zinc, etc. and has been widely used particularly in water where different metals coexist. However, the chromium trioxide has drawbacks similar to those of the sodium nitrite. Amine-based surfactants are insufficient in corrosion inhibiting effect in air as well as in water and will sometimes disturb cooling and washing operations due to marked foamability thereof. Metals treated with the amine-based surfactants, moreover, can not be subjected to parkerizing treatment or coated with paints without removing the surfactants attached thereto. When the surfactants are to be removed, a complicated procedure such as electrolysis is necessary, since it can not be washed off with an alkali solution. Furthermore these known inhibitors can hardly prevent corrosion of metals placed in highly moist atmosphere at elevated temperatures.

An object of the invention is to provide a composition and method for inhibiting corrosion of metals which are free from the drawbacks of the conventional inhibitors.

Another object of the invention is to provide a corrosion inhibiting composition which displays an excellent corrosion inhibiting effect on metals not only in water but also in air.

Another object of the invention is to provide a corrosion inhibiting composition which is low in toxicity and can be exhausted free from water pollution.

Another object of the invention is to provide a corrosion inhibiting composition which has no foamability and therefore can be added to cooling or washing water without adversely affecting cooling or washing operation.

Another object of the invention is to provide a corrosion inhibiting composition which can be easily removed from the surface of metals treated therewith, as desired.

Another object of the invention is to provide a corrosion inhibiting composition which displays a corrosion inhibiting effect on metals in highly moist atmosphere at elevated temperatures.

These and other objects and advantages of the present invention will be apparent from the following description.

The corrosion inhibiting composition of the present invention comprises an aqueous medium having dissolved therein an effective amount of at least one of water-soluble 8-hydroxy-s-triazolo[b]pyridazine compounds and water-soluble salts thereof, said water-soluble 8-hydroxy-s-triazolo[b]pyridazine compound having the formula of

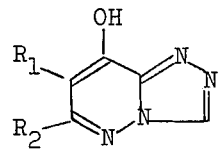

(I)

wherein $R_1$ is hydrogen atom or an alkyl group having 1 to 4 carbon atom; $R_2$ is hydrogen atom, an alkyl group having 1 to 10 carbon atom, phenyl, hydroxyphenyl, nitrophenyl, benzyl, hydroxybenzyl or nitrobenzyl group.

According to the researches of the present inventors it has been unexpectedly found that when metals are treated with the 8-hydroxy-s-triazolo[b]pyridazine and its derivatives specified above, they are effectively protected from corrosion not only in water but also in highly moist air at elevated temperatures. The reason why the 8-hydroxy-s-triazolo[b]pyridazine and its derivatives can display such marked effect on metals has not been fully made clear yet, but it is supposedly attributable to the fact that the surface of metals is covered with a monomolecular film of chelate compound formed between metal atom and 8-hydroxy-s-triazolo[b]-pyridazine or its derivatives to be shut off from air and/or water, whereby the metals are effectively protected from corrosion.

Moreover, metals treated with the present composition can advantageously be subjected to parkerizing treatment or coated with paint without removal of 8-hydroxy-s-triazolo[b]pyridazine or its derivatives therefrom. When metals treated with the present composition are to be chemically or electrically plated, 8-hydroxy-s-triazolo[b]pyridazine or its derivatives attached thereto can easily be removed from the metal surface by simple procedures, for example, by washing with an alkali solution.

The 8-hydroxy-s-triazolo[b]pyridazine and derivatives thereof to be used in the invention are 8-hydroxy-s-triazolo[b]pyridazine compounds having the formula (I) before and water-soluble salts thereof. Representative examples of the 8-hydroxy-s-triazolo[b]-pyridazine compound are 8-hydroxy-s-triazolo[b]pyridazine, 6-methyl-8-hydroxy-s-triazolo[b]pyridazine, 6-methyl-7-isopropyl-8-hydroxy-s-triazolo [b]pyridazine, 6-butyl-7-propyl-8-hydroxy-s-triazolo[b]pyridazine, 6-hexyl-7-methyl-8-hydroxy-s-triazolo [b]pyridazine, 6-decyl-8-hydroxy-s-triazolo[b]pyridazine, 6-phenyl-8-hydroxy-s-triazolo[b]pyridazine, 6-phenyl-7-ethyl-8-hydroxy-s-triazolo[b]pyridazine, 6-benzyl-8-hydroxy-s-triazolo[b]-pyridazine, 6-hydroxyphenyl-8-hydroxy-s-triazolo[b]-pyridazine, 6-hydroxyphenyl-7-methyl-8-hydroxy-s-triazolo[b]pyridazine, 6-nitrophenyl-8-hydroxy-s-triazolo[b]-pyridazine, 6-nitrophenyl-7-methyl-8-hydroxy-s-triazolo-[b]pyridazine, 6-hydroxybenzyl-8-hydroxy-s-triazolo[b]-pyridazine, 6-hydroxybenzyl-7-ethyl-8-hydroxy-s-triazolo-[b]pyridazine, 6-nitrobenzyl-8-hydroxy-s-triazolo[b]-pyridazine, 6-nitrobenzyl-7-ethyl-8-hydroxy-s-triazolo[b]pyridazine, etc. Also employable in the invention are water-soluble salts of the above 8-hydroxy-s-triazolo-[b]pyridazine compounds. Such salts include, for example, ammonium salts, alkali metal salts, hydrazine salts, amine salts and pyridinium salts.

In the invention it is preferable to use the water-soluble salts, since they have lower acidity and display higher water-solubility. Such salts can easily be prepared by adding ammonia, alkali metal hydroxides such as sodium hydroxide, potassium hydroxide etc., hydrazine, amines or pyridinium compounds to an aqueous solution or dispersion of 8-hydroxy-s-triazolo-[b]pyridazine compounds to produce the solution having a pH adjusted as about 6.5 to 10. Employable amine include various amines capable of producing water-soluble salts by the reaction with the 8-hydroxy-s-triazolo[b]pyridazine compounds. Examples thereof are alkanol amines such as monoethanolamine, diethanolamine, etc., alkylamines such as isopropylamine, ethylenediamine, propylenediamine, dicyclohexylamine, etc.

Particularly preferable 8-hydroxy-s-triazolo[b-]pyridazine compounds having the formula (I) before are, for example, 8-hydroxy-s-triazolo[b]pyridazine, 6-methyl-8-hydroxy-s-triazolo[b]pyridazine, 6-methyl-7-isopropyl-8-hydroxy-s-triazolo[b]pyridazine, 6-butyl-7-propyl-8-hydroxy-s-triazolo[b]pyridazine, 6-hexyl-7-methyl-8-hydroxy-s-triazolo[b]pyridazine, 6-decyl-8-hydroxy-s-triazolo[b]pyridazine, 6-phenyl-8-hydroxy-s-triazolo[b]-pyridazine, 6-phenyl-7-ethyl-8-hydroxy-s-triazolo[b]-pyridazine, 6-benzyl-8-hydroxy-s-triazolo[b]pyridazine and water-soluble salts thereof.

The 8-hydroxy-s-triazolo[b]pyridazine compounds to be used in the invention are known in the art and can be prepared, for example, by the reaction of N-amino-1,2,4-triazine with dicarboxylic acid ester having the general formula of

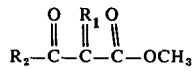

wherein $R_1$ and $R_2$ are the same as defined before [J. Am. Chem. Soc. Vol. 81, P. 6289(1959)].

The metals to which the present composition is applied include ferrous metals such as iron, cast iron, mild steel, carbon steel, stainless steel, etc., copper metals such as copper, brass, beryllium copper, cupronickel, etc. and zinc metals such as zinc, etc.

The 8-hydroxy-s-triazolo[b]pyridazine and derivatives thereof to be used as corrosion inhibitor in the invention are water-soluble, so that they can be applied to the metals in the manner conventional to water-soluble corrosion inhibitors. For example, metals may be brought into contact with the present corrosion inhibitor by coating them with an aqueous solution of the inhibitor, followed by drying, or by adding the inhibitor to water to be brought into contact with the metals. In the latter case, the present inhibitor is added to water such a cooling water in the rolling of metals, cooling water in a cooling system, washing water for pickled or degreased metals, etc. Since the present inhibitor is thermally stable, it displays an excellent corrosion inhibiting effect in various water of near 0°C in winter as well as in cooling water of about 60° to 80°C in rolling operation.

The effective concentration of the present inhibitor in an aqueous medium varies over a wide range depending on the application method, kind of metals to be treated, etc., but it displays a corrosion-inhibiting effect in such a small concentration as 0.001 weight percent. Since the present inhibitor has little or no toxicity, it can be used in any large amount. But it is preferable to use the inhibitor in a concentration of not more than 5 weight percent from economical view point. Particularly, when the present inhibitor is used in the form of an aqueous solution for coating metals, preferable concentration of the inhibitor in solution is in the range of 1.0 to 3.0 weight percent. When the present inhibitor is added to water with which metals are brought into contact, preferable concentration thereof in the water system is in the range of 0.01 to 0.05 weight percent.

Various additives can be added to the present composition in order to improve the properties thereof. For example, water-soluble high molecular weight substances are added thereto to further improve the corrosion inhibiting effect on metals. Examples thereof are polyvinyl alcohol, polyvinyl pyrrolidone, carboxymethyl cellulose, starch, polyacrylic acid, styrene-maleic acid copolymer, etc. Further, surfactants are added in order to improve wettability of ferrous metals to be treated with the present composition. Examples of such surfactants are nonionic surfactants such as polyoxyethylene octyl ester, polyoxyethylene alkylphenyl ether, polyoxyethylene lauryl ether, polyoxyethylene oleyl ether, polyoxyethylene nonylphenyl ether, polyoxyethylene octyl ester, etc.; cationic surfactants such as quaternary ammonium salts, etc.; anionic surfactants such as ammonium salt of alkylbenzenesulfonate, sodium salt of polyoxyethylene nonylphenyl ether sulfate, ammonium laurate, ammonium oleate, ammonium stearate, etc.

For a better understanding of the present invention examples are given below.

EXAMPLE 1

8-hydroxy-s-triazolo[b]pyridazine compounds shown in Table 1 below were respectively dissolved at 50 °C in water containing 50 p.p.m. of $Cl^-$, 50 p.p.m. of $SO_4^{--}$ and 50 p.p.m. of $HCO_3^-$, and the resulting solutions were adjusted with sodium hydroxide solution to a pH of 7 to prepare compositions according to this invention.

Test pieces of steel, cast iron, copper and galvanized steel were respectively immersed at 50 °C for 10 days in the compositions obtained as above to inspect corrosion produced. The results of this corrosion test are given as the reduction of weight of respective test pieces in Table 1 below which also shows the results conducted using the water containing the same corrosive ions in the same amounts.

Table 1

Corrosion inhibitor used

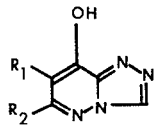

| Test No. | $R_1$ | $R_2$ | Amount used (p.p.m.) | Test piece[1)] | Reduction of weight by corrosion ($mg/cm^2$) |
|---|---|---|---|---|---|
| 1 | H | 6-$CH_3$ | 100 | Steel | 0.07 |
| 2 | 7-$CH_3CH_2CH_2$ | 6-$C_{10}H_{21}$ | 100 | " | 0.11 |
| 3 | H | 6-$CH_3(CH_2)_4CH_2$ | 500 | Cast iron | 0.15 |
| 4 | H | 6-$C_6H_5CH_2$ | 500 | " | 0.23 |
| 5 | 7-$C_2H_5$ | 6-$(CH_3)_2CH$ | 50 | Copper | 0.03 |
| 6 | H | 6-$C_8H_{17}$ | 100 | Galvanized steel | 0.13 |
| Comparison 1 | — | — | — | Steel | 15.3 |
| Comparison 2 | — | — | — | Cast iron | 19.8 |
| Comparison 3 | — | — | — | Copper | 0.11 |
| Comparison 4 | — | — | — | Galvanized steel | 0.97 |

Note: [1)]Test pieces were pre-treated as follows.
a) Steel: cold-rolled steel sheets of JIS G 3141, Class 1 (SPCC), measuring 60 mm × 80 mm × 1.2 mm, were polished by polishing paper (JIS R 6251, No. E. 240), washed with petroleum naphtha at 50°C and further with methanol at 50°C, in accordance with JIS Z 2912.
b) Cast iron: cast iron sheets of JIS G 5501, Class 3 (FC-20), measuring 60 mm × 80 mm × 3 mm, were pre-treated in the same manner as the steel sheets of a) above.
c) Copper: copper sheets of JIS H 310, Class 1 (TCuP-1), measuring 60 mm × 80 mm × 1.2 mm, were pre-treated in the same manner as the steel sheets of a) above.
d) Galvanized steel: galvanized steel sheets of JIS H 8610 (ZMC-4), measuring 60 mm × 80 mm × 1 mm, were washed with petroleum naphta at 50°C and further with methanol at 50°C.

The results shown in Table 1 indicate that the compositions of this invention exhibit outstanding corrosion inhibiting effects on ferrous metals, copper and zinc in water containing large amount of corrosive ions.

The $LD_{50}$ test was conducted using male Wistar rats after 24 hours' fasting weighing 150 g, each 10 rats as a group. An aqueous solution containing 25% by weight of 6-methyl-8-hydroxy-s-triazolo[b]pyridazine ammonium salt was forcibly administered orally to the rats and the rats were raised for 1 week in a constant temperature and constant humidity chamber at a temperature of 22°C and humidity of 65%. The $LD_{50}$ as determined by Litchfield Wilcoxon method was about 3750 mg/kg which is about 1/45 the $LD_{50}$ of 85 mg/kg for sodium nitrite as determined in rats. This indicates that the present composition is very low in toxicity.

EXAMPLE 2

Cold-rolled steel sheets of JIS G 3141, Class 1 (SPCC), each measuring 60 mm × 80 mm × 1.2 mm, were pre-treated in the same manner as the Example 1 in accordance with JIS Z 2912. The resulting steel sheets were then immersed in the present compositions shown in Table 2 below for 30 seconds respectively, dried and thereafter placed for 10 days in humidity cabinets at a temperature of 49° ± 1°C and relative humidity of not lower than 95% according to JIS Z 0228 to inspect corrosion produced. The results are given in Table 2 below which also shows the result of the steel sheet which was likewise placed in humidity cabinet without application of the present composition.

Table 2

Corrosion inhibitor used

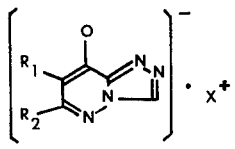

| Test No. | $R_1$ | $R_2$ | X | Concentration (wt.%) | Corrosion[2)] |
|---|---|---|---|---|---|
| 7 | H | 6-$CH_3$ | 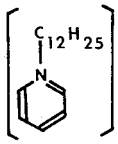 | 2 | A |

Table 2-continued

Corrosion inhibitor used

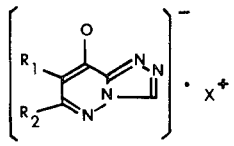

| Test No. | $R_1$ | $R_2$ | X | Concentration (wt.%) | Corrosion*2) |
|---|---|---|---|---|---|
| 8 | H | 6-$CH_3(CH_2)_4CH_2$ | $NH_4$ | 1.5*1 | A |
| 9 | 7-$C_2H_5$ | 6-$CH_3$ | 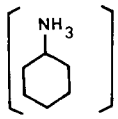 | 2 | B |
| 10 | H | H | $NH_4$ | 2 | B |
| Comparison 5 | — | — | — | — | E |

Note: *1This composition further contains 1 wt.% of ammonium oleate in concentration.
*2The resulting corrosion was evaluated according to JIS Z 2912 based on the following criteria:

| Symbol | Degree of corrosion (%) |
|---|---|
| A | 0 |
| B | 1 - 10 |
| C | 11 - 25 |
| D | 26 - 50 |
| E | 51 - 100 |

The results of Table 2 above show that the compositions of this invention effectively prevent corrosion of metals in highly moist atmosphere at an elevated temperature.

EXAMPLE 3

Cold-rolled steel sheets of JIS G 3141, Class 1 (SPCC), each measuring 60 mm × 80 mm × 1.2 mm, were polished and washed in the same manner as in Example 1 and then immersed in the present compositions shown in Table 3 below for 30 seconds. After dried in a desiccator, the steel sheets thus treated were placed in a storage-shed according to JIS Z 0231 for 20 days. The resulting corrosion measured according to JIS Z 2912 are listed Table 3, which also shows the result obtained by using an aqueous solution having dissolved therein 1 wt.% of sodium nitrite and 0.01 wt.% of carboxymethyl cellulose.

Table 3

Corrosion inhibitor used

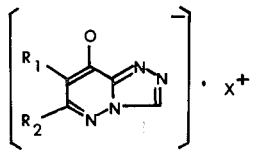

| Test No. | $R_1$ | $R_2$ | X | Concentration (wt.%) | Additive Kind | Additive Concentration (wt.%) | Corrosion*1 |
|---|---|---|---|---|---|---|---|
| 11 | H | 6-$C_6H_5$ | $NH_4$ | 2 | Carboxymethyl cellulose | 0.01 | A |
| 12 | H | 6-$C_6H_4(OH)$ | $NH_2NH_3$ | 2 | Polyoxyethylene octyl ester | 0.1 | A |
| 13 | H | 6-$CH_3$ | $NH_4$ | 1 | Ammonnium stearate | 1 | A |
| 14 | 7-$CH_3CH_2CH_2$ | 6-$CH_3CH_2CH_2CH_2$ | K | 0.5 | — | — | B |
| Comparison No. 6 | | Sodium nitrite | | 2 | Carboxymethyl cellulose | 0.01 | E |

Note:
*1Criteria of corrosion are the same as in Example 2.

What we claim is:

1. A method for inhibiting corrosion of metal which comprises contacting a metal with a composition consisting essentially of an aqueous medium having dissolved therein an amount in the range of from 0.001 to 5 weight percent of at least one water-soluble 8-hydroxy-s-triazolo (b) pyridazine compound and water-soluble salts thereof selected from the group consisting of ammonium salts, alkali metal salts, hydrazine salts and amine salts, said water-soluble 8-hydroxy-s-triazolo(b)-pyradazine compound having the formula of

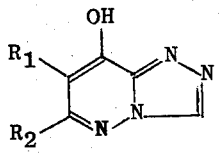

wherein $R_1$ is hydrogen atom or an alkyl group having 1 to 4 carbon atoms: $R_2$ is hydrogen atom, an alkyl having 1 to 10 carbon atoms, phenyl, hydroxyphenyl, nitrophenyl, benzyl, hydroxybenzyl or nitrobenzyl group.

2. The method of inhibiting corrosion of a metal according to claim 1, wherein said metal to be contacted with said composition is at least one of iron, copper, zinc and alloys thereof.

* * * * *